US008979551B2

(12) United States Patent
Mongold et al.

(10) Patent No.: US 8,979,551 B2
(45) Date of Patent: Mar. 17, 2015

(54) LOW-PROFILE MEZZANINE CONNECTOR

(71) Applicant: Samtec, Inc., New Albany, IN (US)

(72) Inventors: John Mongold, Middletown, PA (US); Randall Musser, Enola, PA (US); Brian Vicich, Prospect, KY (US)

(73) Assignee: Samtec, Inc., New Albany, IN (US)

( * ) Notice: Subject to any disclaimer, the term of this patent is extended or adjusted under 35 U.S.C. 154(b) by 43 days.

(21) Appl. No.: 13/688,392

(22) Filed: Nov. 29, 2012

(65) Prior Publication Data

US 2014/0148022 A1 May 29, 2014

(51) Int. Cl.

| | |
|---|---|
| ***H01R 12/00*** | (2006.01) |
| ***H01R 12/73*** | (2011.01) |
| *H01R 12/70* | (2011.01) |
| *H01R 12/71* | (2011.01) |

(52) U.S. Cl.

CPC ..... *H01R 12/73* (2013.01); *H01R 12/7052* (2013.01); *H01R 12/716* (2013.01)

USPC ..... 439/74

(58) Field of Classification Search

USPC ..... 439/74, 65, 66, 660

See application file for complete search history.

(56) References Cited

U.S. PATENT DOCUMENTS

| | | | | |
|---|---|---|---|---|
| 6,338,630 | B1 | 1/2002 | Dong | |
| 6,702,590 | B2 | 3/2004 | Zaderej et al. | |
| 6,793,506 | B1 | 9/2004 | Hirata et al. | |
| 6,918,776 | B2 | 7/2005 | Spink, Jr. | |
| 7,014,475 | B1 | 3/2006 | Mongold | |
| 7,179,091 | B2 | 2/2007 | Mongold | |
| 7,429,176 | B2 | 9/2008 | Johnescu et al. | |
| 7,828,559 | B2 * | 11/2010 | Chen et al. | 439/74 |
| 2004/0063344 | A1 * | 4/2004 | Shin | 439/74 |
| 2006/0276060 | A1 | 12/2006 | Takano | |
| 2010/0330821 | A1 | 12/2010 | Takeuchi et al. | |
| 2011/0045679 | A1 | 2/2011 | Yu | |
| 2013/0137281 | A1 * | 5/2013 | Hirakawa | 439/65 |
| 2014/0194006 | A1 | 7/2014 | Hsu et al. | |

FOREIGN PATENT DOCUMENTS

JP 2007-018993 A 1/2007

OTHER PUBLICATIONS

Official Communication issued in corresponding International Patent Application PCT/US2013/056334, mailed on Dec. 13, 2013.
Panasonic Corporation, "Narrow pitch connectors (0.5mm pitch) P5KF series," AXK(5/6)F, 2012, 10 pages.
JST, "JAN connector," JST Catalog, pp. 146-148.

(Continued)

*Primary Examiner* — Vanessa Girardi
(74) *Attorney, Agent, or Firm* — Keating & Bennett, LLP

(57) ABSTRACT

A mezzanine connector includes a first connector including a pass-through hole and a first plurality of contacts arranged around the pass-through hole, the first connector arranged to be connected to a first substrate such that the first plurality of contacts are connected to the first substrate, and a second connector including a beam and a second plurality of contacts arranged around the beam, the second connector arranged to be connected to a second substrate such that the second plurality of contacts are connected to the second substrate. The pass-through hole extends fully through the first connector in a mating direction of the first connector and the second connector, and the beam of the second connector is arranged to extend into the pass-through hole of the first connector when the first connector and the second connector are mated.

20 Claims, 16 Drawing Sheets

(56) References Cited

OTHER PUBLICATIONS

FCI, "Mezzostak 0.5MM Mezzanine Connectors," ELXMEZZSTAK0611EA4, 2 pages.

Molex, "Mezzanine 1.00mm (.039") Pitch," http://molex.ttieurope.com/products_items/board_to_board/mezzanine/overview.cfm, retrieved Oct. 2, 2012, 1 page.

Samtec, "High Speed Board-to-Board Mezzanine Strips," http://www.samtec.com/highspeed/mezzanine_strips.aspx, retrieved Oct. 2, 2012, 3 pages.

Ryan et al., "Ultra Low-Profile Connectors", U.S. Appl. No. 14/468,659, filed Aug. 26, 2014.

* cited by examiner

LOW-PROFILE MEZZANINE CONNECTOR

BACKGROUND OF THE INVENTION

1. Field of the Invention

The present invention relates to electrical connectors and more specifically, the present invention relates to a mezzanine connector having a low profile.

2. Description of the Related Art

Electrical connectors are used to allow electrical devices, such as substrates or printed circuit boards, to communicate with one another. A connector may be thought of as having two portions, one portion which connects to a first electrical device and the second portion which connects to a second electrical device to be put into communication with the first device. To connect the two electrical devices, the two portions of the connector are mated together.

Each connector includes one set of contacts in a first portion and a second set of contacts in a second portion to be connected with contacts of the first portion. This can be readily accomplished by providing a male connector and a female connector with corresponding sets of contacts that engage when the male and female connectors are mated. Further, the male and female connectors are easily connected and disconnected from each other to respectively electrically connect and disconnect the electrical devices to which they are connected.

Accordingly, each connector portion is connected to an electrical device through its contacts. The contacts are typically permanently connected to the electrical device. Further, the connector portions are typically secured to electrical devices by fusing the contacts to contact pads or other suitable structure provided on the electrical device.

Recently, there has been a trend toward miniaturization of most electrical devices. As electrical devices become smaller and more complex, the connectors used with these electrical devices must also become smaller and must be able to accommodate the more complex electrical devices. One problem with miniaturized connectors arises from the increased precision (i.e., tighter tolerances) of placement necessary to produce the proper positioning and connection of the connector contacts onto the electrical device. This problem is exacerbated by the ever-increasing input/output (I/O) density requirements demanded of the progressively smaller connectors by increasingly miniaturized electrical devices. As the number of contacts increases in each connector, it becomes more and more difficult to maintain desired levels of coplanarity, while maintaining connection of all of the contacts to a substrate.

In order to provide for a higher density of substrates, mezzanine connectors have been used. Mezzanine connectors are typically used to connect a first substrate to a second substrate in a parallel manner. A conventional mezzanine connector assembly includes a male connector to be mounted on one substrate, and a female connector to be mounted on another substrate. The male connector includes a plurality of contacts that each engages a corresponding contact on the female connector when the male connector and the female connector are mated, thereby establishing electrical contact between the two substrates. The individual electrical contacts in the male and female connectors are used to conduct electrical signals or electrical power. Examples of mezzanine connectors can be found in U.S. Pat. Nos. 6,702,590 and 6,918,776.

As the progression toward higher density continues, it has become useful to reduce the distance between substrates that are connected by mezzanine connectors by modifying the structure of the mezzanine connectors. However, conventional mezzanine connectors have a number of problems, as described below.

As shown in FIGS. 6 and 7 of U.S. Pat. No. 6,702,590, one problem with conventional mezzanine connectors is that the distance between the substrates is limited by the heights of the plug and the receptacle. That is, the plug is only partially inserted into the receptacle, such that the heights of both the plug and the receptacle significantly contribute to the overall height of the mated plug and receptacle and thus the distance between the substrates.

As shown in FIGS. 48 and 49 of U.S. Pat. No. 6,702,590, another problem with conventional mezzanine connectors is that reducing the heights of the plug and/or receptacle also reduces wipe distances of the contacts when the plug and receptacle are connected, which may negatively affect the performance and longevity of the electrical connection. A wipe distance between corresponding contacts refers to a distance between a first point where the corresponding contacts initially touch during mating of the plug and receptacle, and a second point where the contacts are positioned when the plug and the receptacle are fully mated. Along the wipe distance, oxides and other substances are wiped off of the corresponding contacts due to their physical engagement, thereby improving a mechanical connection between the contacts. A short wipe distance may cause poor electrical performance due to a weak mechanical connection between the corresponding contacts.

Furthermore, poor electrical performance in mezzanine connectors may result from a force normal to the mating direction of the plug and receptacle being insufficient to wipe off the oxides and other substances from the corresponding contacts. However, if the force normal to the mating direction of the plug and the receptacle is too great, one or more of the contacts may bend or buckle when the plug and receptacle are mated. Accordingly, proper alignment between the plug and the receptacle during mating is important to help ensure that the force normal to the mating direction of the plug and the receptacle is sufficient to wipe off the oxides and other substances from the corresponding contacts, yet insufficient to cause any of the contacts to bend or buckle. As an example, cantilevered contacts are particularly susceptible to variations in the force normal to the mating direction of the plug and the receptacle.

As shown in FIG. 1 of U.S. Pat. No. 6,918,776, an additional problem with conventional mezzanine connectors is that the distance between the substrates is also limited due to both the plug and the receptacle being mounted on the surface of substrate. That is, a distance between each of the plug and the receptacle and a surface of each of the substrates contributes to the distance between the substrates.

A further problem with conventional mezzanine connectors is the use of multiple folded contacts in the plug and receptacle that require the width of the connector to be much wider. For example, the Panasonic P5KF series of mezzanine connectors have contacts that are folded over multiple times, which causes these connectors to have a substantial width.

SUMMARY OF THE INVENTION

To overcome the problems described above, preferred embodiments of the present invention provide a low-profile mezzanine connector with a long contact wipe distance.

A mezzanine connector according to a preferred embodiment of the present invention includes a first connector including a pass-through hole and a first plurality of contacts arranged around the pass-through hole, the first connector arranged to be connected to a first substrate such that the first plurality of contacts are connected to the first substrate and a second connector including a beam and a second plurality of contacts arranged around the beam, the second connector arranged to be connected to a second substrate such that the second plurality of contacts are connected to the second substrate. The pass-through hole extends fully through the first connector in a mating direction of the first connector and the second connector, and the beam of the second connector is arranged to extend into the pass-through hole of the first connector when the first connector and the second connector are mated such that each of the first plurality of contacts engages with a respective one of the second plurality of contacts The first connector is preferably arranged to fit into a cut-out of the first substrate. The first connector preferably includes recessed portions and a main body that are arranged to fit into the cut-out of the first substrate. At least one of the first connector and the second connector preferably includes at least one post to engage with at least one corresponding post hole in the first or second substrate.

A wipe distance of the first plurality of contacts and the second plurality of contacts is preferably about 0.6 mm or greater. A distance between the first substrate and the second substrate is preferably about 2 mm or less. A wipe distance of the first plurality of contacts and the second plurality of contacts is preferably greater than a distance between the first substrate and the second substrate.

The first connector is preferably soldered to the first substrate, and the second connector is preferably soldered to the second substrate. A portion of each of the first plurality of contacts is preferably arranged to be soldered to the first substrate and preferably includes a ribbed or multi-planar area that limits the flow of solder, and a portion of each of the second plurality of contacts is preferably arranged to be soldered to the second substrate and preferably includes a ribbed or multi-planar area that limits the flow of solder.

The first plurality of contacts is preferably arranged in at least one row, and the second plurality of contacts is preferably arranged in at least one row. The beam of the second connector preferably touches the first substrate when the first connector is mated with the second connector. A bottom surface of the beam of the second connector is preferably parallel or substantially parallel to a bottom surface of the first connector.

The first connector preferably includes at least one first retention tab, and the second connector preferably includes at least one second retention tab. The at least one first retention tab is preferably arranged to be connected to the first substrate, and the at least one second retention tab is preferably arranged to be connected to the second substrate. A height of each of the first plurality of first contacts is preferably equal to or greater than a height of the at least one first retention tab, and a height of each of the plurality of second contacts is preferably equal to or greater than a height of the at least one second retention tab.

A receptacle connector according to a preferred embodiment of the present invention includes a plurality of contacts and a pass-through hole. The plurality of contacts is arranged in at least one row along the pass-through hole. The pass-through hole extends fully through the receptacle connector such that when the receptacle connector mates with another connector, a bottom surface of the another connector is co-planar or substantially co-planar to a bottom surface of the receptacle connector.

The receptacle connector is preferably arranged to fit to a cut-out of a substrate. The receptacle connector preferably includes recessed portions and a main body that are arranged to fit into the cut-out of the substrate. The pass-through hole preferably extends along the receptacle connector between a first retention tab and a second retention tab of the receptacle connector.

A connector assembly according to a preferred embodiment of the present invention includes a first connector including a pass-through hole and a first plurality of contacts arranged along the pass-through hole, a second connector including a beam and a second plurality of contacts arranged along the beam, a first substrate, and a second substrate. The first connector is arranged to be connected to the first substrate such that the first plurality of contacts is connected to the first substrate. The first connector includes a pass-through hole extending fully through the first connector in a mating direction of the first connector and the second connector. The second connector is arranged to be connected to the second substrate such that the second plurality of contacts is connected to the second substrate. The beam of the second connector is arranged to engage the pass-through hole of the first connector when the first connector and the second connector are connected such that each of the first plurality of contacts engages with a respective one of the second plurality of contacts.

The first substrate and the second substrate preferably each include a cut-out or a recess. The first connector is preferably arranged to fit to the cut-out or the recess of the first substrate. The second connector is preferably arranged to fit to the cut-out or the recess of the second substrate.

Accordingly, the preferred embodiments of the present invention provide a relatively narrow mezzanine connector with a low stack height and long wipe lengths for contacts.

The above and other features, elements, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will now be described in detail with reference to FIGS. 1A to 9. Note that the following description is in all aspects illustrative and not restrictive, and should not be construed to restrict the applications or uses of the present invention in any manner.

FIGS. 1A to 4B show a mezzanine connector 100 according to a preferred embodiment of the present invention.

Figure 1A:
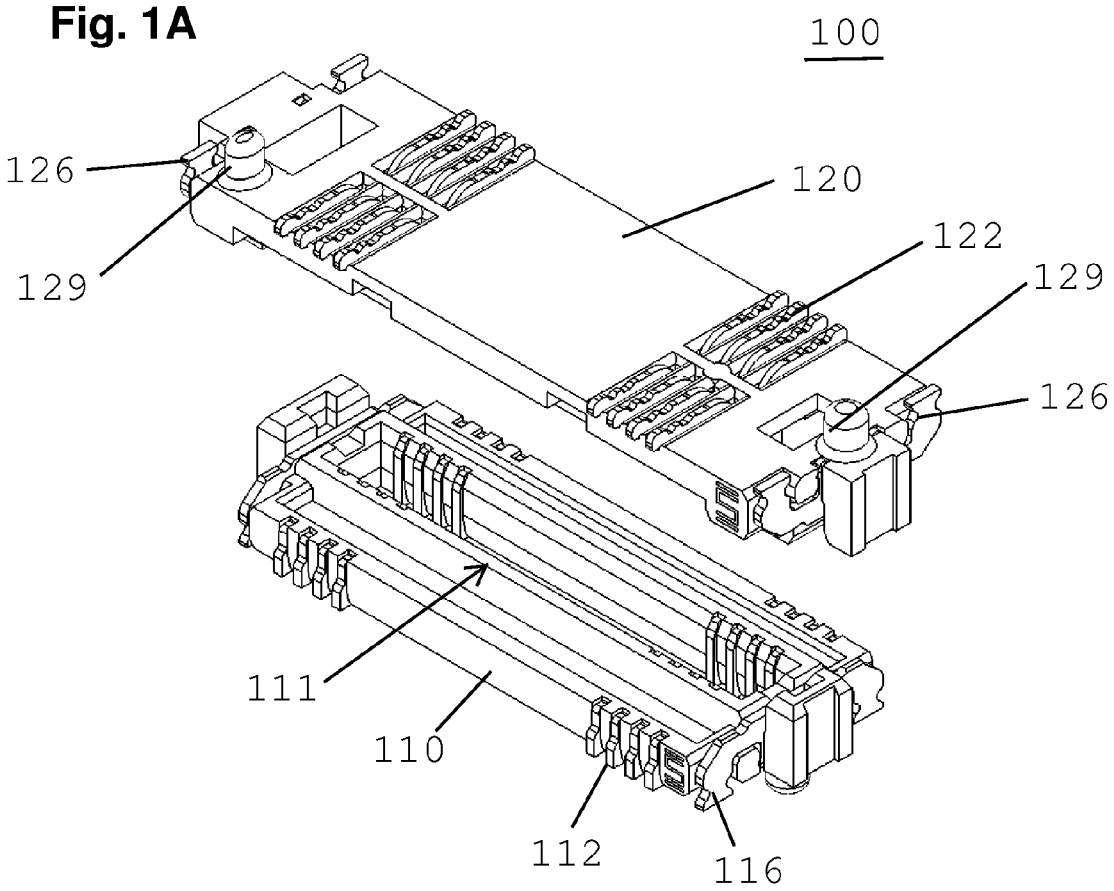
FIGS. 1A and 1B are perspective views of a mezzanine connector in accordance with a preferred embodiment of the present invention.
Figure 1B:
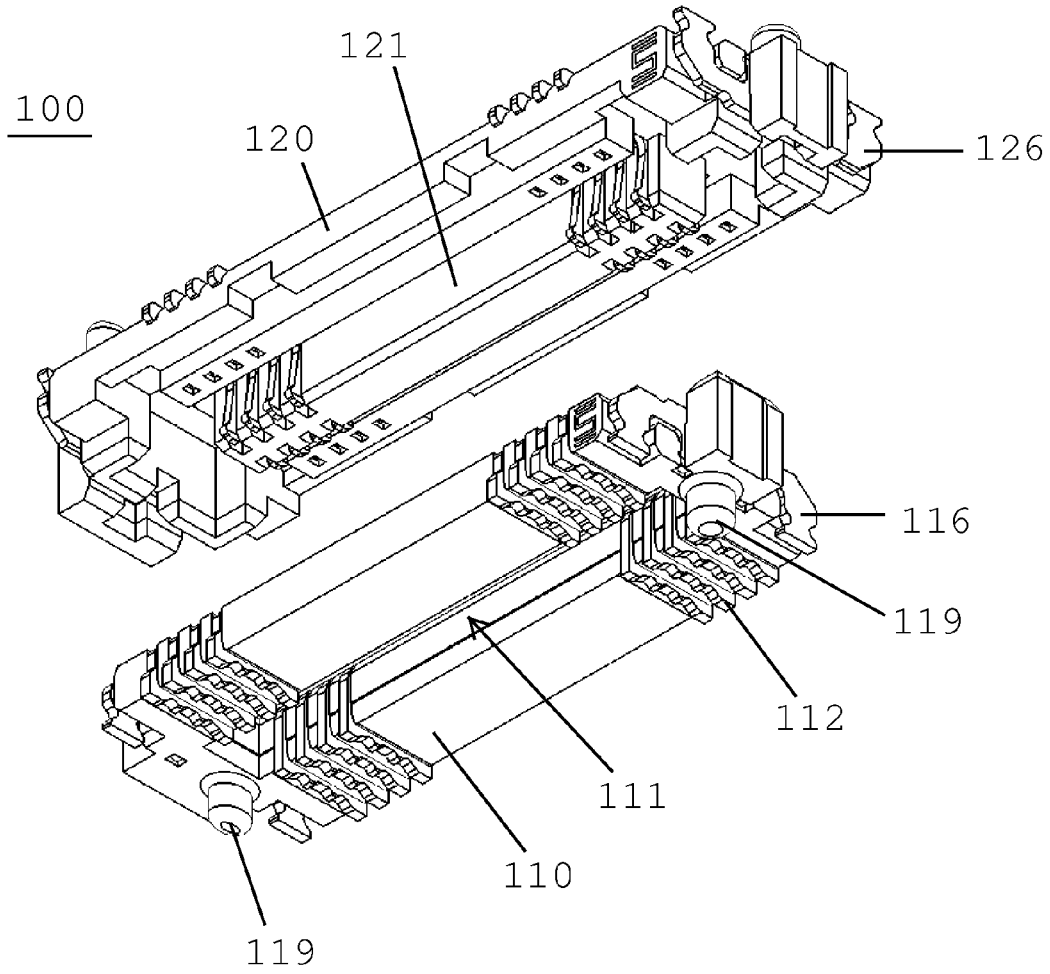
Figure 2A:
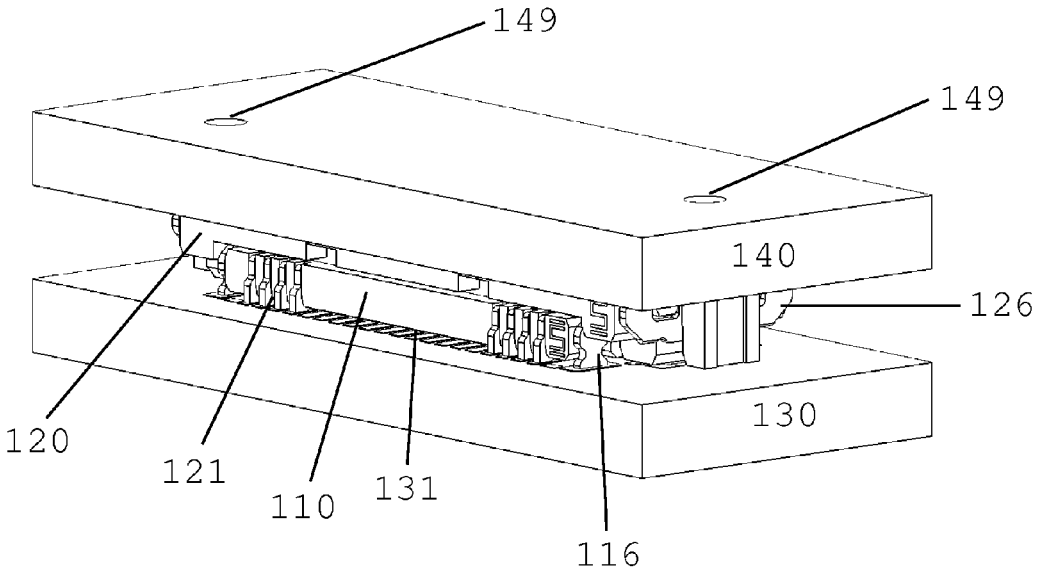
FIGS. 2A and 2B are perspective views of the mezzanine connector of FIGS. 1A and 1B connecting two substrates.
Figure 2B:
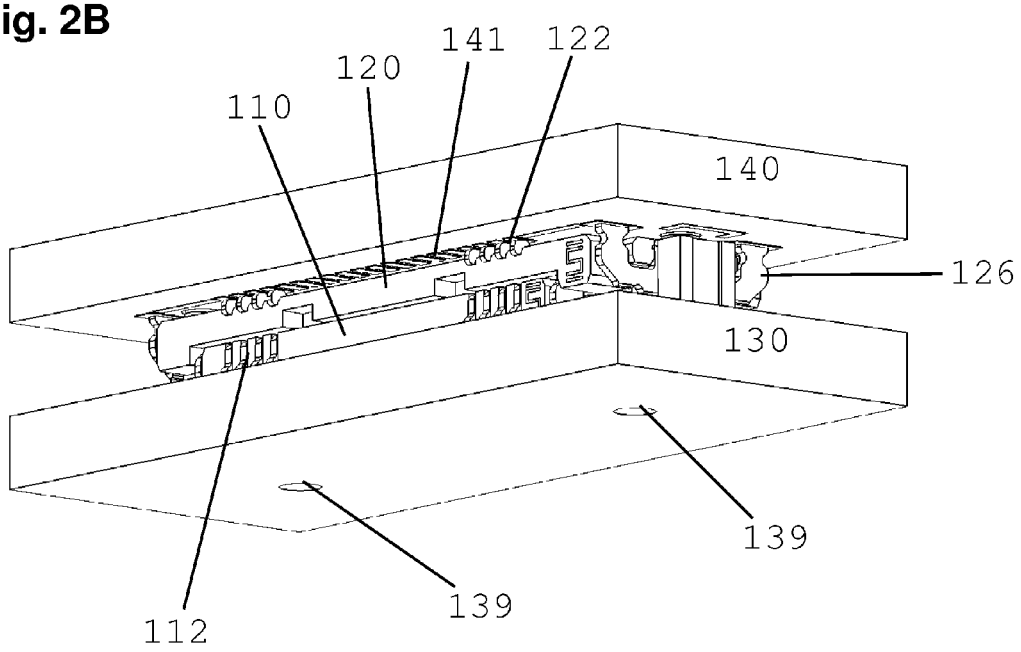
Figure 3A:
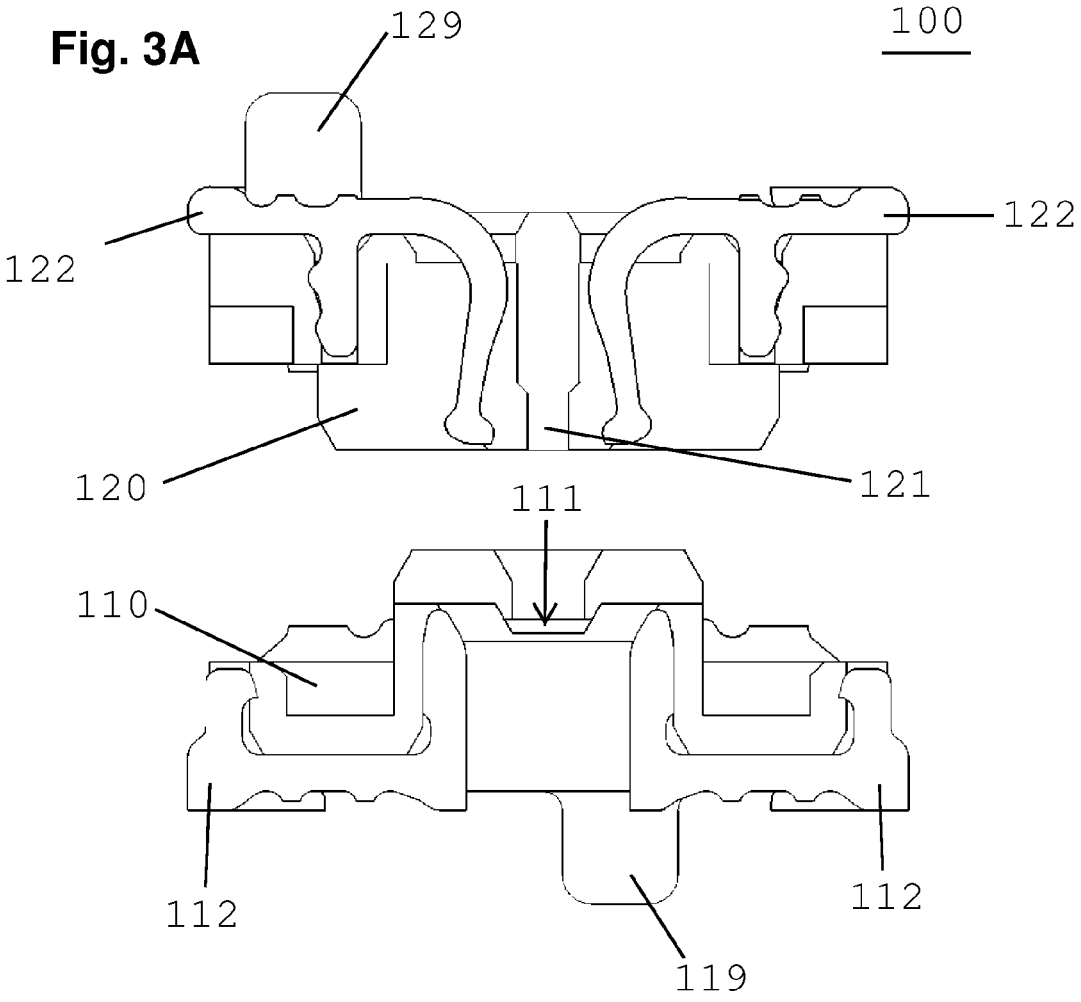
FIG. 3A is a cross-sectional end view of the mezzanine connector of FIGS. 1A and 1B.
Figure 3B:
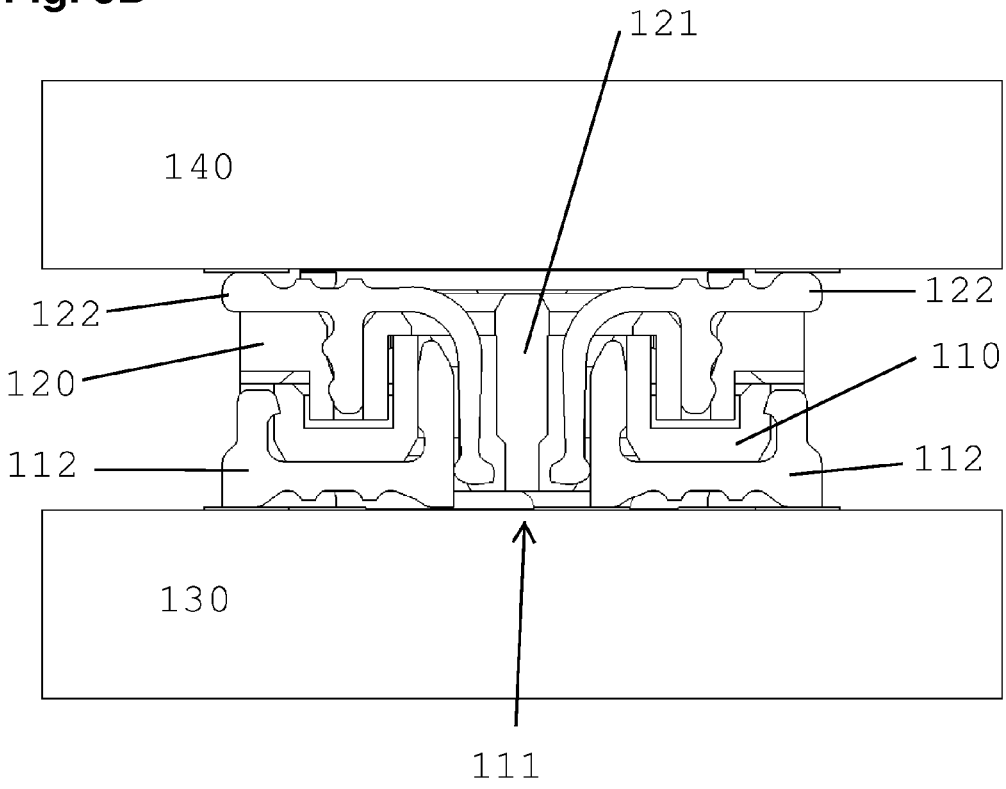
FIG. 3B is a cross-sectional end view of the mezzanine connector of FIGS. 1A and 1B connecting the two substrates of FIGS. 2A and 2B.
Figure 4A:
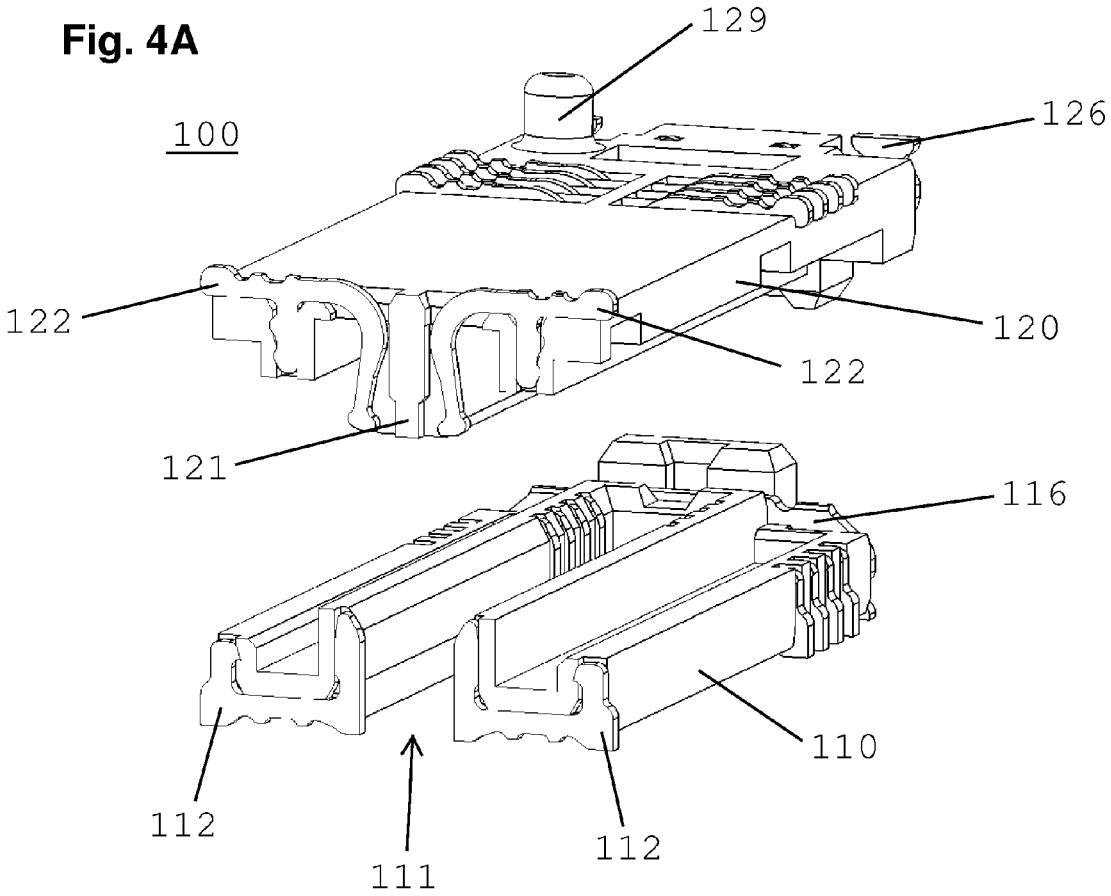
FIG. 4A is a cross-sectional perspective view of the mezzanine connector of FIGS. 1A and 1B.
Figure 4B:
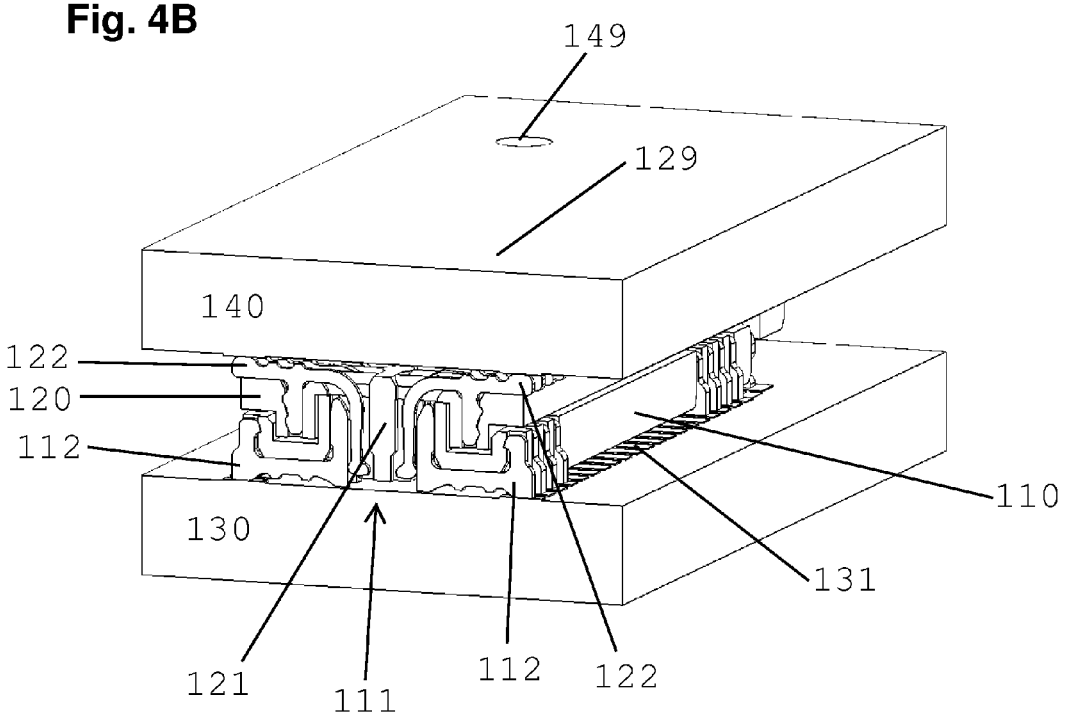
FIG. 4B is a cross-sectional perspective view of the mezzanine connector of FIGS. 1A and 1B connecting the two substrates of FIGS. 2A and 2B.

FIGS. 1A and 1B are perspective views of the mezzanine connector 100 according to a preferred embodiment of the present invention. FIGS. 2A and 2B are perspective views of the mezzanine connector 100 of FIGS. 1A and 1B connecting a first substrate 130 to a second substrate 140. FIG. 3A is a cross-sectional end view of the mezzanine connector 100 of FIGS. 1A and 1B. FIG. 3B is a cross-sectional end view of the mezzanine connector 100 connecting the first substrate 130 and the second substrate 140. FIG. 4A is a cross-sectional perspective view of the mezzanine connector 100 of FIGS. 1A and 1B. FIG. 4B is a cross-sectional perspective view of the mezzanine connector 100 connecting the first substrate 130 and the second substrate 140.

The mezzanine connector according to a preferred embodiment of the present invention includes a receptacle 110 (a male connector) and a plug 120 (a female connector).

The receptacle 110 preferably includes receptacle contacts 112 which may be connected to respective connection pads 131 on the first substrate 130. For simplicity, not all of the receptacle contacts 112 are shown in FIGS. 1A-4B. Preferably, the receptacle contacts 112 are arranged in two rows to be parallel or substantially parallel, within manufacturing tolerances, with respect to each other. The receptacle contacts 112 and the connection pads 131 are preferably connected, for example, by solder. As a particular example, a reflow solder operation may be used to connect the receptacle contacts 112 to the connection pads 131. Preferably, portions of the receptacle contacts 112 arranged to connect to the connection pads 131 have ribbed or multi-planar shapes to help prevent the flow of solder into a wipe area of the receptacle contacts 112. Further, solder may flow to retaining arms of the receptacle contacts 112 that are press-fit into corresponding holes in the receptacle 110, thereby helping secure the receptacle contacts 112 to the receptacle 110 and preventing the solder from flowing to the wipe area of the receptacle contacts 112.

Retention tabs 116 arranged at ends of the receptacle 110 help to secure the receptacle 110 to the first substrate 130, particularly during mating and un-mating with the plug 120. Preferably, each of the receptacle contacts 112 has a height equal to or greater than the retention tabs 116. Receptacle posts 119 arranged on a receptacle mounting surface of the receptacle 110 and post holes 139 of the first substrate 130 position the receptacle 110 when the receptacle 110 is mounted to the first substrate 130 to help ensure proper alignment between the receptacle contacts 112 and the connection pads 131 and proper orientation of the receptacle 110 with respect to the substrate to which the receptacle 110 is connected.

The plug 120 preferably includes plug contacts 122 which may be connected to respective connection pads 141 on the second substrate 140. For simplicity, not all of the plug contacts 122 are shown in FIGS. 1A-4B. Preferably, the plug contacts 122 are arranged in two rows to be parallel or substantially parallel, within manufacturing tolerances, with respect to each other. The plug contacts 122 and the connection pads 141 are preferably connected, for example, by solder. As a particular example, a reflow solder operation may be used to connect the plug contacts 122 to the connection pads 141. Preferably, portions of the plug contacts 122 arranged to connect to the connection pads 141 have ribbed or multi-planar shapes to help prevent the flow of solder into a wipe area of the plug contacts 122. Further, solder may flow to retaining arms of the plug contacts 122 that are press-fit into corresponding holes in the plug 120, thereby helping secure the plug contacts 122 to the plug 120 and preventing the solder from flowing to the wipe area of the plug contacts 122.

Retention tabs 126 arranged at ends of the plug 120 help to secure the plug 120 to the second substrate 140, particularly during mating and un-mating with the receptacle 110. Preferably, each of the plug contacts 122 has a height equal to or greater than the retention tabs 126. Plug posts 129 arranged on a plug mounting surface of the plug 120 and post holes 149 of the second substrate 140 position the plug 120 when the plug 120 is mounted to the second substrate 140 to help ensure proper alignment between the plug contacts 122 and the connection pads 141 and proper orientation of the plug 120 with respect to the substrate to which the plug 120 is connected.

The receptacle 110 includes a pass-through hole 111 arranged to receive a beam 121 of the plug 120 when the plug 120 is mated with the receptacle 110. A surface of the beam 121 facing the first substrate 130 may be in close proximity to, or may even touch, the first substrate 130. Preferably, the surface of the beam 121 facing the first substrate 130 is parallel or substantially parallel, within manufacturing tolerances, to a bottom surface of the receptacle 110. The receptacle contacts 112 are exposed at the pass-through hole 111, and the plug contacts 122 are exposed at the beam 121. Thus, the receptacle contacts 112 and the plug contacts 122 are connected when the beam 121 is inserted into the pass-through hole 111.

As shown in FIGS. 1A to 4B, the above-described arrangement of the receptacle 110 and the plug 120 provides a stable physical connection between the receptacle 110 and the plug 120.

Furthermore, the above-described arrangement of the receptacle 110 and the plug 120 provides a long wipe distance between the receptacle contacts 112 and the plug contacts 122, thereby cleaning oxides and other substances from the contacts 112, 122 when the plug 120 is inserted into the receptacle 110. Preferably, the wipe distance between the receptacle contacts 112 and the plug contacts 122 is between about 0.6 mm and about 0.9 mm. However, the wipe distance between the receptacle contacts 112 and the plug contacts 122 is not limited thereto, and may be about 1 mm or more. Accordingly, an improved mechanical and electrical connection between the receptacle contacts 112 and the plug contacts 122 may be achieved.

Moreover, the above-described arrangement of the receptacle 110 and the plug 120 provides a small spacing between the first substrate 130 and the second substrate 140, thus allowing a denser arrangement of substrates. Preferably, a distance between the first substrate 130 and the second substrate 140 is between about 2 mm and about 4 mm.

FIGS. 5A to 8 show a mezzanine connector 200 according to another preferred embodiment of the present invention.

Figure 5A:
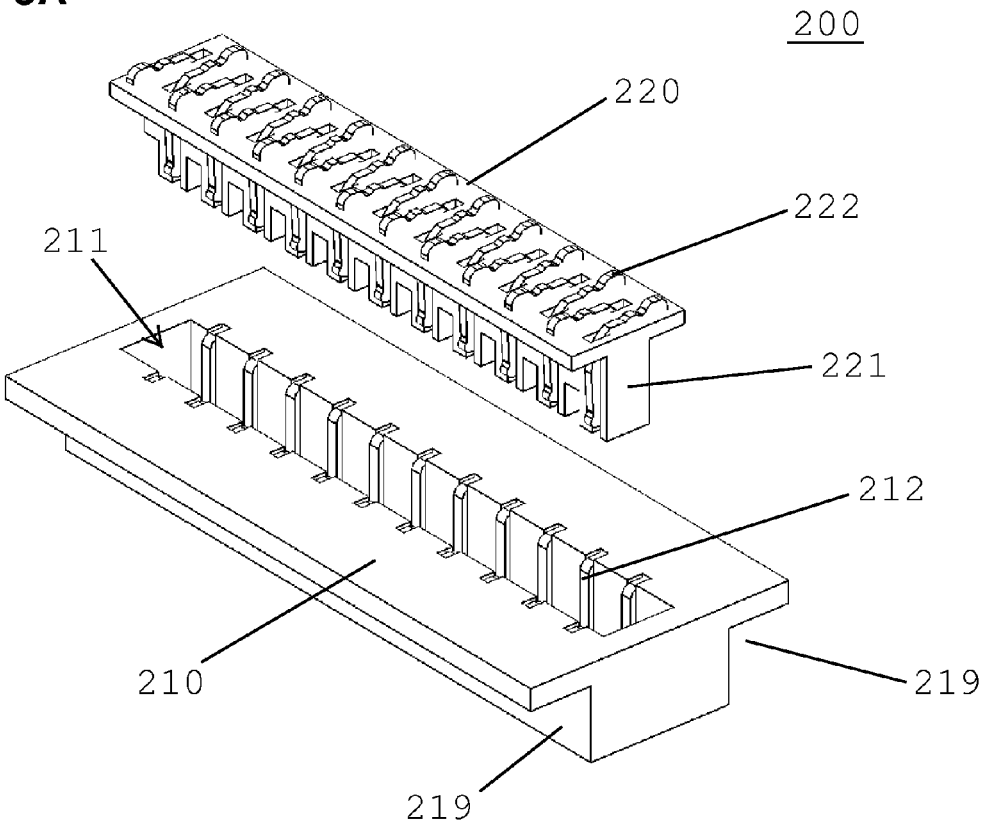
FIGS. 5A and 5B are perspective views of a mezzanine connector in accordance with a preferred embodiment of the present invention.
Figure 5B:
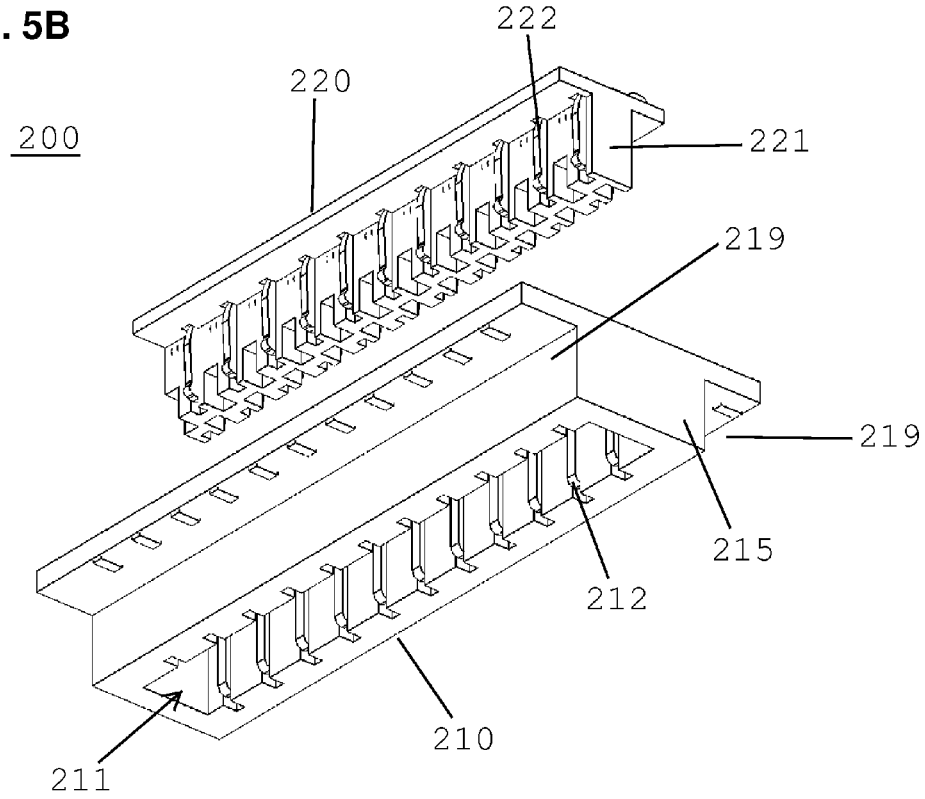
Figure 6A:
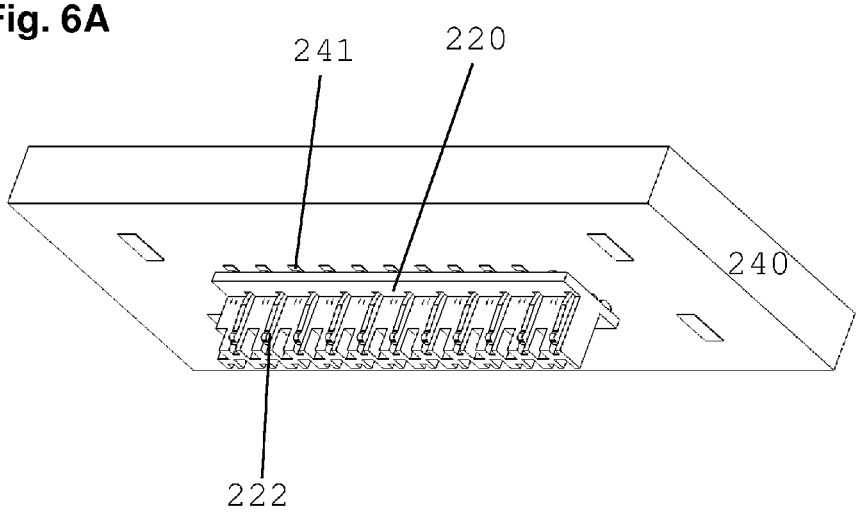
FIG. 6A is a perspective view of the plug of the mezzanine connector of FIGS. 5A and 5B mounted on a substrate.
Figure 6B:
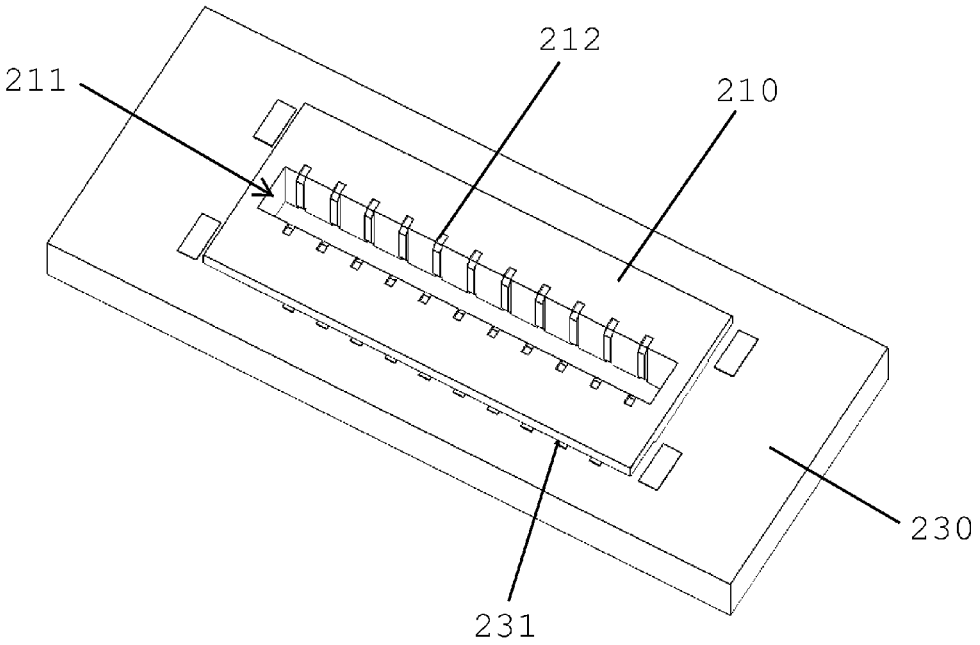
FIG. 6B is a perspective view of the receptacle of the mezzanine connector of FIGS. 5A and 5B mounted on to a substrate.
Figure 6C:
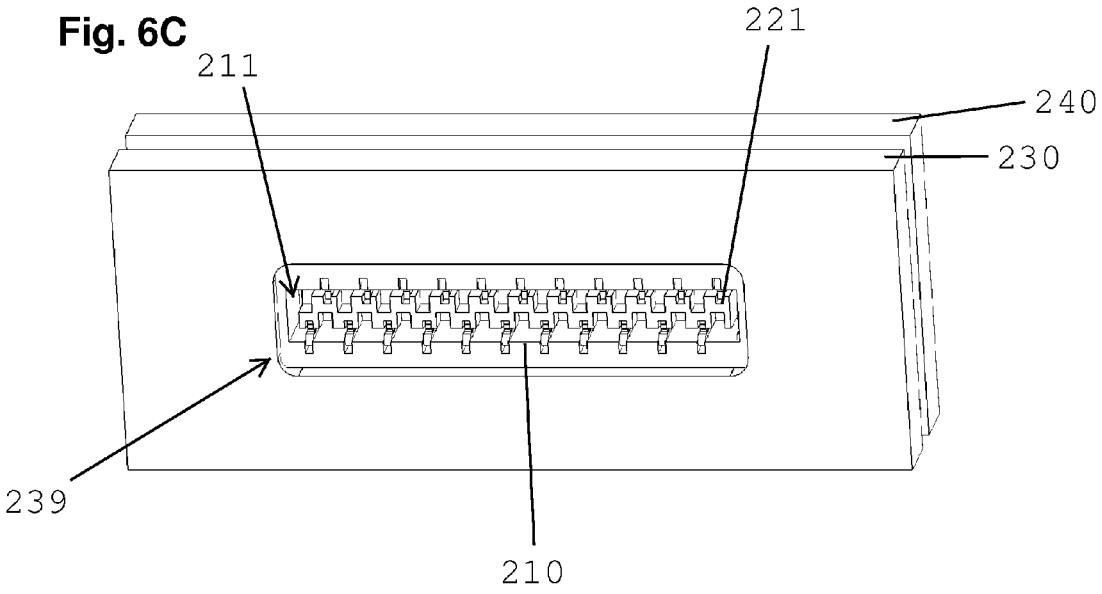
FIG. 6C is a perspective view of the mezzanine connector of FIGS. 5A and 5B connecting two substrates.
Figure 6D:
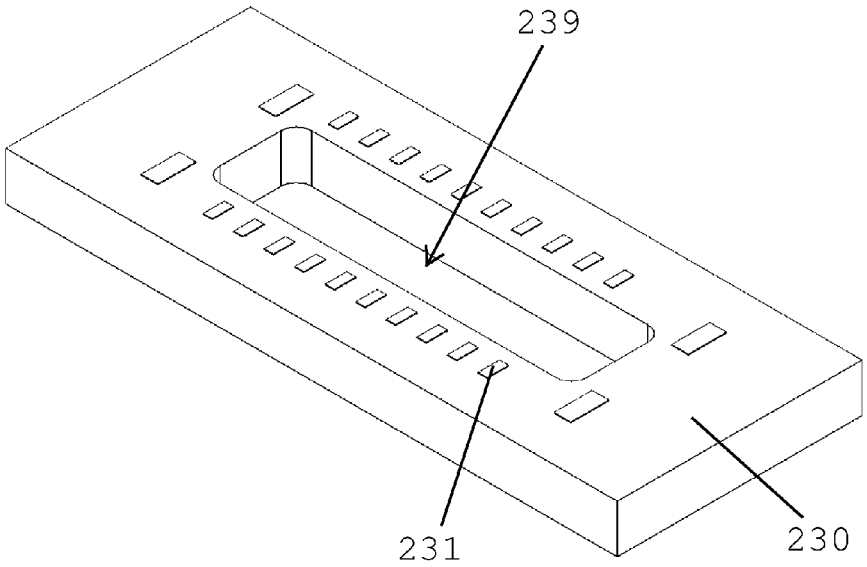
FIG. 6D is a perspective view of the substrate of FIG. 6B.
Figure 7A:
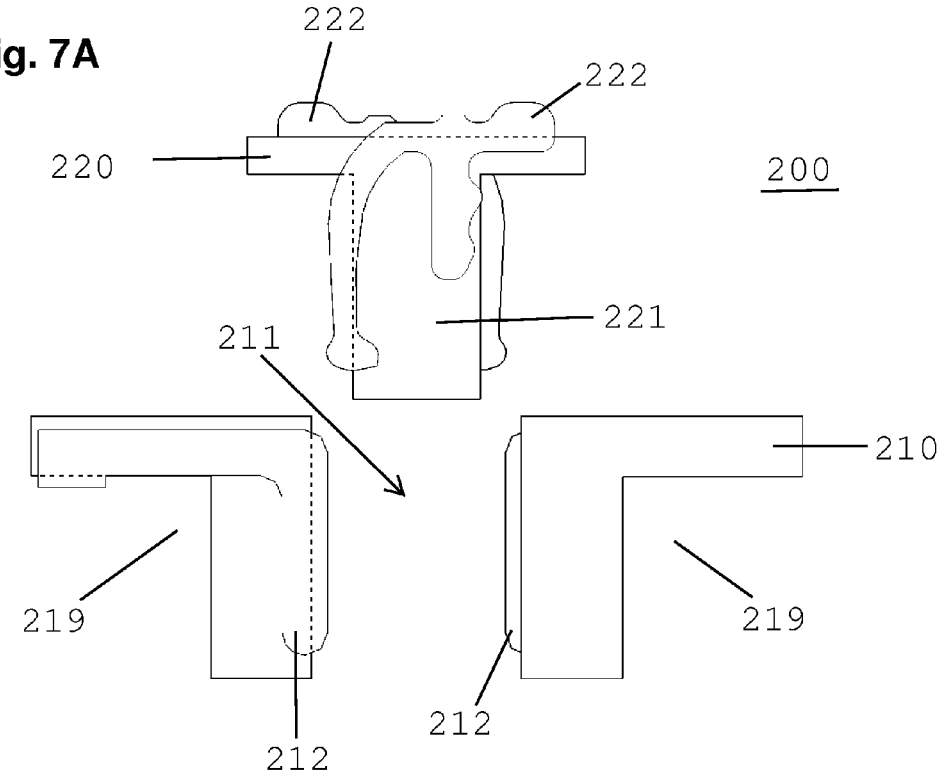
FIG. 7A is a cross-sectional end view of the mezzanine connector of FIGS. 5A and 5B prior to the plug being attached to the receptacle.
Figure 7B:
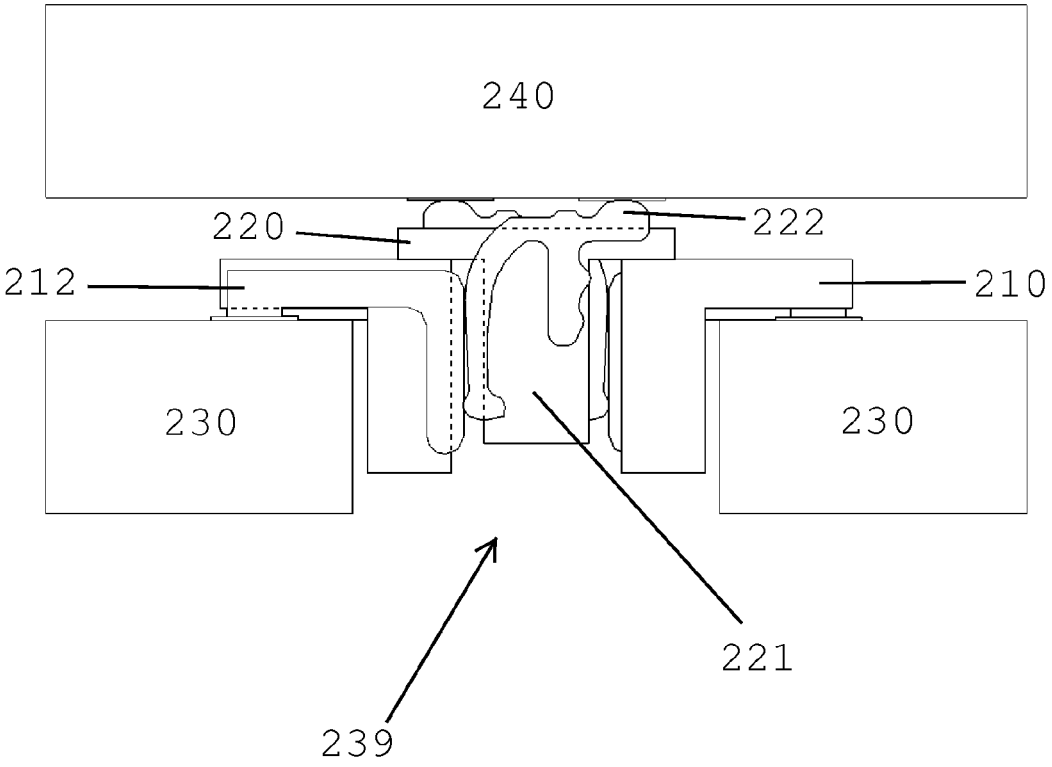
FIG. 7B is a cross-sectional end view of the mezzanine connector of FIGS. 5A and 5B connecting two substrates.
Figure 8:
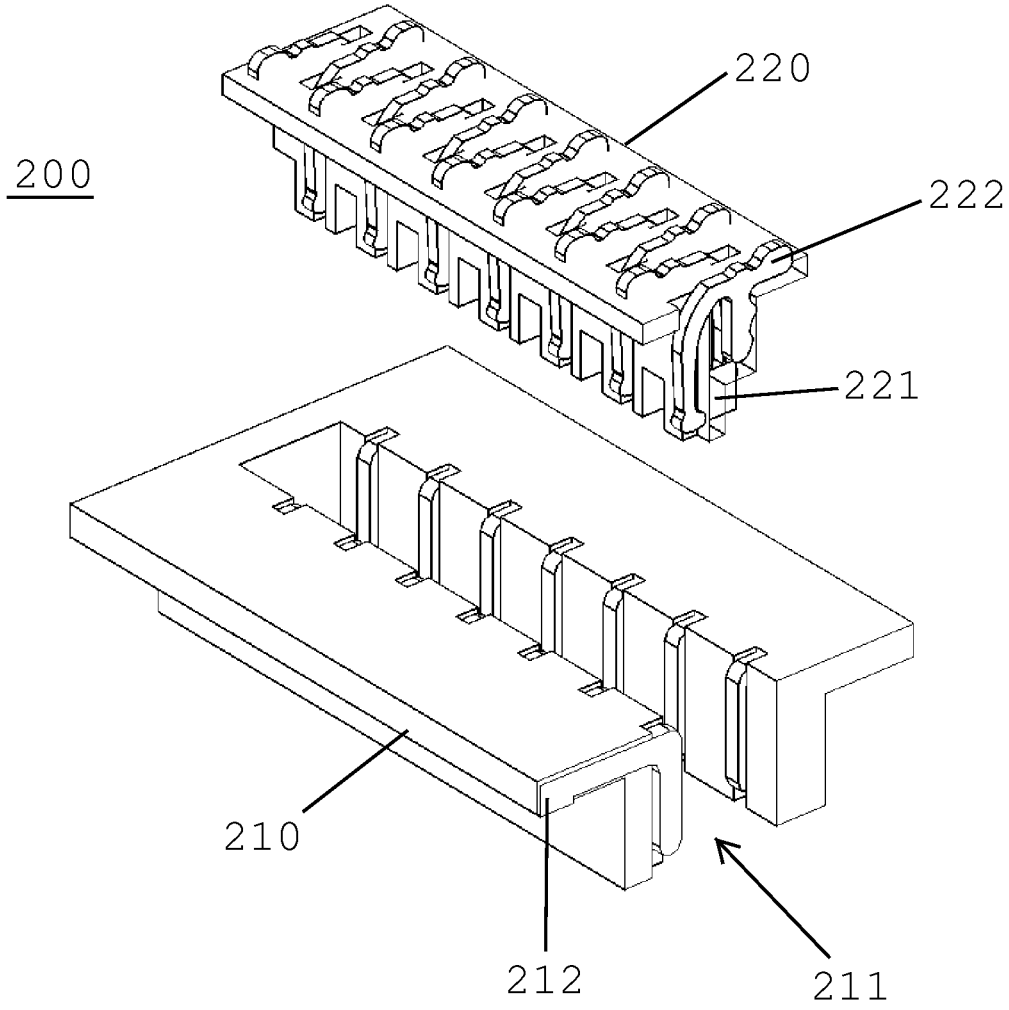
FIG. 8 is a cross-sectional perspective view of the mezzanine connector of FIGS. 5A and 5B.

FIGS. 5A and 5B are perspective views of a mezzanine connector 200 in accordance with a preferred embodiment of the present invention. FIG. 6A is a perspective view of the plug 220 of the mezzanine connector 200 of FIGS. 5A and 5B mounted on a second substrate 240. FIG. 6B is a perspective view of the receptacle 210 of the mezzanine connector 200 of FIGS. 5A and 5B mounted on a first substrate 230. FIG. 6C is a perspective view of the mezzanine connector 200 of FIGS. 5A and 5B connecting the first substrate 230 with the second substrate 240. FIG. 6D is a perspective view of the first substrate 230. FIG. 7A is a cross-sectional end view of the mezzanine connector 200 of FIGS. 5A and 5B prior to the plug 220 being mated with the receptacle 210. FIG. 7B is a cross-sectional end view of the mezzanine connector 200 of FIGS. 5A and 5B after the plug 220 is mated with the receptacle 210. FIG. 8 is a cross-sectional perspective view of the mezzanine connector 200 of FIGS. 5A and 5B.

The receptacle 210 preferably includes receptacle contacts 212 which may be connected to respective connection pads 231 of a first substrate 230. Preferably, the receptacle contacts 222 are arranged in two rows to be parallel or substantially parallel, within manufacturing tolerances, with respect to each other. The receptacle contacts 212 and the connection pads 231 are preferably connected, for example, by solder. As a particular example, a reflow solder operation may be used to connect the receptacle contacts 212 to the connection pads 231. Preferably, portions of the receptacle contacts 212 arranged to connect to the connection pads 231 have ribbed or multi-planar shapes to help prevent the flow of solder into a wipe area of the receptacle contacts 212. Further, solder may flow to retaining arms of the receptacle contacts 212 that are press-fit into corresponding holes in the receptacle 210, thereby helping secure the receptacle contacts 212 to the receptacle 210 and preventing the solder from flowing to the wipe area of the receptacle contacts 212.

The plug 220 preferably includes plug contacts 222 which may be connected to respective connection pads 241 of a second substrate 240. Preferably, the plug contacts 222 are arranged in two rows to be parallel or substantially parallel, within manufacturing tolerances, with respect to each other. The plug contacts 222 and the connection pads 241 are preferably connected, for example, by solder. As a particular example, a reflow solder operation may be used to connect the plug contacts 222 to the connection pads 241. Preferably, portions of the plug contacts 222 arranged to connect to the connection pads 241 have ribbed or multi-planar shapes to help prevent the flow of solder into a wipe area of the plug contacts 222. Further, solder may flow to retaining arms of the plug contacts 222 that are press-fit into corresponding holes in the plug 220, thereby helping secure the plug contacts 222 to the plug 220 and preventing the solder from flowing to the wipe area of the plug contacts 222.

The receptacle 210 includes a pass-through hole 211 arranged to receive a beam 221 of the plug 220 when the plug 220 is mated with the receptacle 210. A surface of the beam 221 facing the first substrate 230 may be in close proximity to, or may even touch, the first substrate 230. Preferably, the surface of the beam 221 facing the first substrate 230 is co-planar or substantially co-planar, within manufacturing tolerances, to a bottom surface of the receptacle 210. The receptacle contacts 212 are exposed at the pass-through hole 211, and the plug contacts 222 are exposed at the beam 221. Thus, the receptacle contacts 212 and the plug contacts 222 are connected when the beam 221 is inserted into the pass-through hole 211. Furthermore, the receptacle 210 includes recesses 219 so that a main body 215 of the receptacle 210 fits into a cut-out 239 of the first substrate 230. FIG. 6D shows a perspective view of the first substrate 230.

As shown in FIGS. 5A to 8, the above-described arrangement of the receptacle 210 and the plug 220 provides a stable physical connection between the receptacle 210 and the plug 220.

Furthermore, the above-described arrangement of the receptacle 210 and the plug 220 provides a long wipe distance between the receptacle contacts 212 and the plug contacts 222, thereby cleaning oxides or other substances from the contacts 212, 222 when the plug 220 is inserted into the receptacle 210. Preferably, the wipe distance between the receptacle contacts 212 and the plug contacts 222 is between about 0.8 mm and 1.2 mm. However, the wipe distance between the receptacle contacts 212 and the plug contacts 222 is not limited thereto, and may be greater than 1.2 mm. Accordingly, an improved mechanical and electrical connection between the receptacle contacts 212 and the plug contacts 222 may be achieved.

Moreover, the above-described arrangement of the receptacle 210 and the plug 220 provides a small spacing between the first substrate 230 and the second substrate 240, thus allowing a denser arrangement of substrates. Preferably, a distance between the first substrate 230 and the second substrate 240 is between about 1 mm to about 6 mm.

Figure 9:
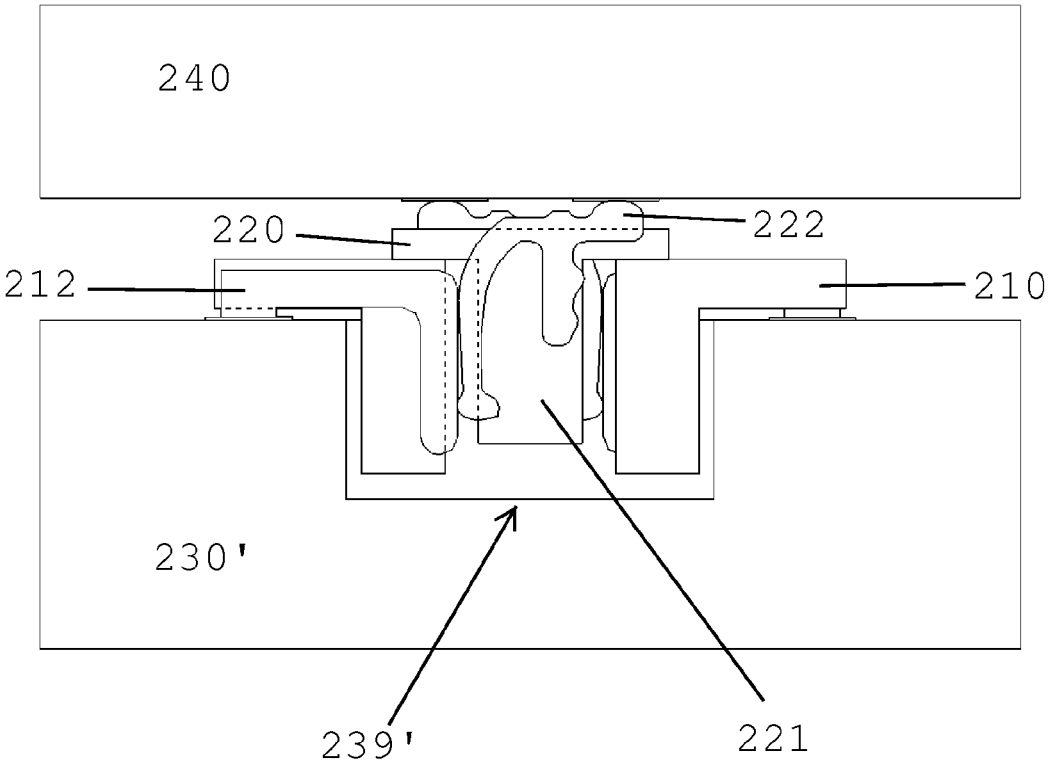
FIG. 9 is a cross-sectional end view of the mezzanine connector of FIGS. 5A and 5B connecting two substrates.

While preferred embodiments of the present invention show the receptacle 210 preferably being fit into a cut-out 239 of the first substrate 230, the first substrate may be provided with a recess that does not extend through the first substrate instead of a cut-out 239 in order to fit the plug 220. FIG. 9 is a cross-sectional end view of the mezzanine connector 200 of FIGS. 5A and 5B connecting a first substrate 230' with a recess 239' to a second substrate 240. For example, the recess 239' may be included in the first substrate 230' if the first substrate 230' is a relatively thick substrate, if it is desired to include routing in the first substrate 230' under the mezzanine connector 200, or if electrical traces are included on a side of the first substrate 230' that is opposite to the mezzanine connector 200. Using recess 239' allows for some routing underneath the recess 239' that would not be available if a cut-out 239 was used.

Figure 10:
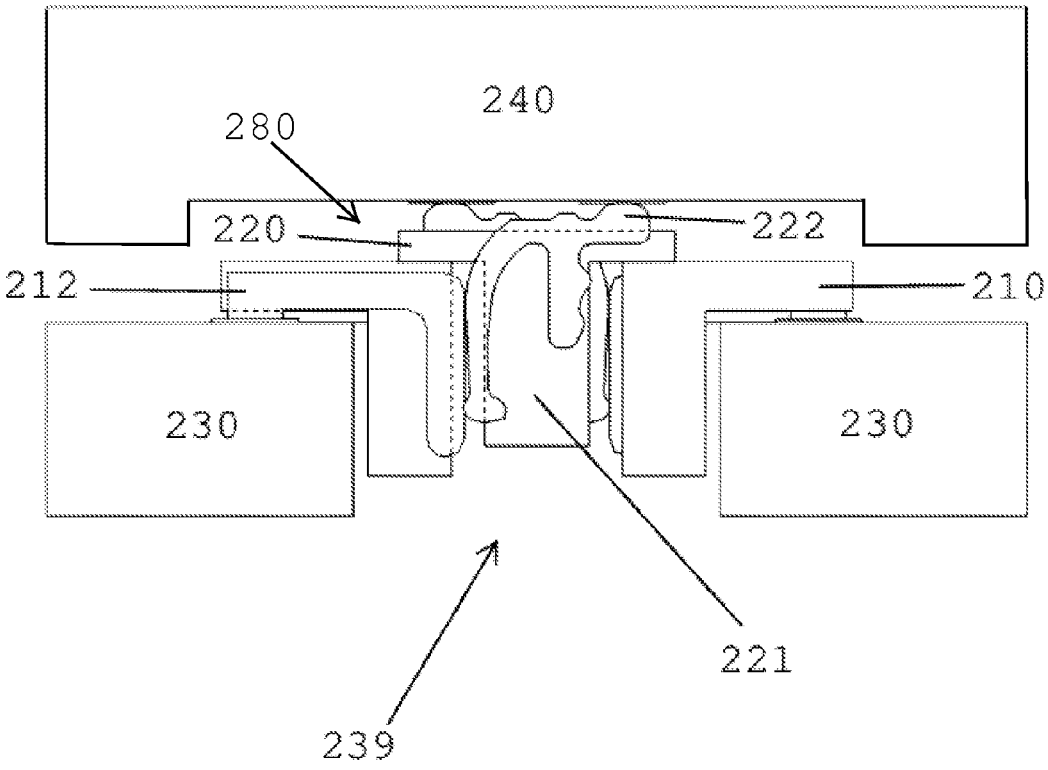
FIG. 10 is a cross-sectional end view of the mezzanine connector of FIGS. 5A and 5B prior to the plug being attached to the receptacle.
Figure 11:
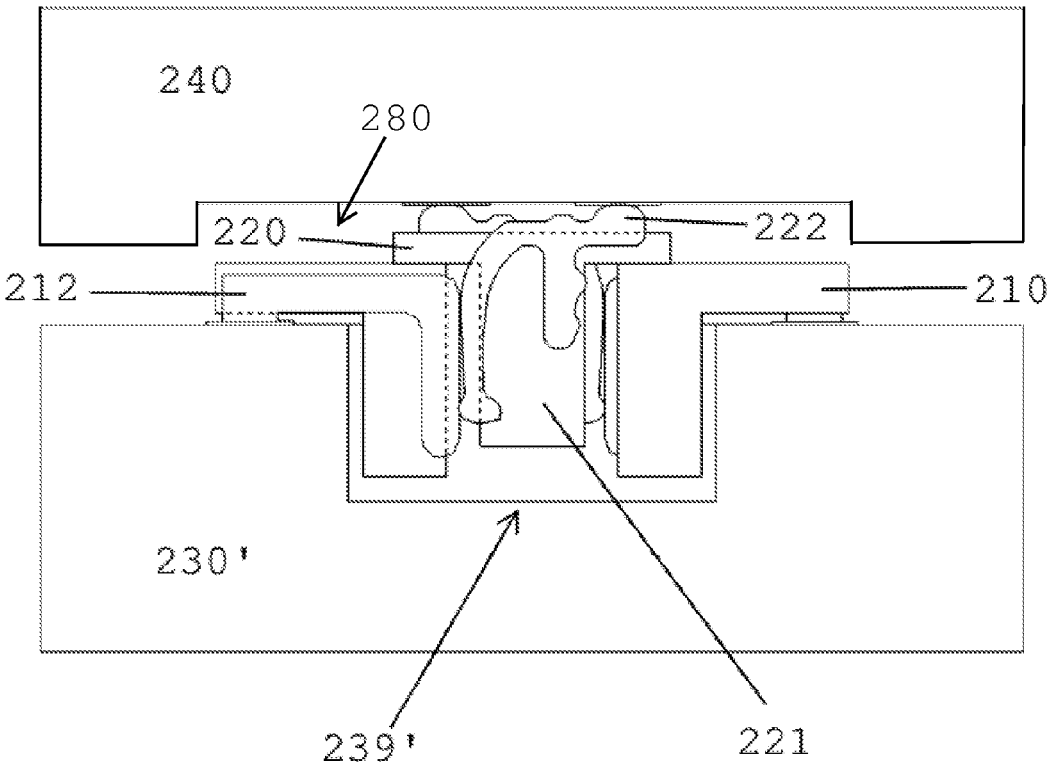
FIG. 11 is a cross-sectional end view of the mezzanine connector of FIGS. 5A and 5B connecting two substrates.

Also, the plug 220 may be fitted into a cut-out or recess 280 of the second substrate 240 as shown in FIGS. 10 and 11, in addition to or as an alternative to the receptacle 210 being fit into the cut-out 239 or recess of the first substrate 230. Furthermore, the receptacle 110 and the plug 120 may be respectively fitted to cut-outs or recesses in the first substrate 130 and the second substrate 140. Using cut-outs or recesses in both the first substrate 130, 230 and the second substrate 140, 240 could allow the distance between the first substrate 130, 230 and the second substrate 140, 240 to be less than 1 mm. Accordingly, as a result of a mezzanine connector according to the preferred embodiments of the present invention being fitted into a cut-out or a recess of at least one substrate, wipe distances of the contacts 112, 122, 212, 222 can be greater than or equal to the distance between the first substrate 130, 230 and the second substrate 140, 240.

Also, receptacle posts may be arranged on the receptacle 210, and post holes may be arranged on the first substrate 230 to position the receptacle 210 when the receptacle 210 is mounted to the first substrate 230 to help ensure proper alignment between the receptacle contacts 212 and the connection pads 231 and proper orientation of the receptacle 210 with respect to the substrate to which the receptacle 210 is connected. Similarly, plug posts may be arranged on the plug 220, and post holes may be arranged on the second substrate 240 to position the plug 220 when the plug 220 is mounted to the second substrate 240 to help ensure proper alignment between the plug contacts 222 and the connection pads 241 and proper orientation of the plug 220 with respect to the substrate to which the plug 220 is connected.

Moreover, while preferred embodiments of the present invention show the receptacle 110 preferably including a pass-through hole for the beam 121 of the plug 120, one or more pass-through holes may be provided in the plug 120 to allow for insertion of a corresponding component of the receptacle 110, for example, to further reduce the distance between the first substrate 130 and the second substrate 140.

According to the preferred embodiments of the present invention, an initial point of contact between the receptacle contacts 112, 212 and the plug contacts 122, 222 during mating of the plugs 120, 220 to the receptacles 110, 210 is arranged at a side of the receptacles 110, 210 closest to the second substrates 140, 240 and a side of the plugs 120, 220 closest to the first substrates 130, 230. Furthermore, a resting point of contact between the receptacle contacts 112, 212 and the plug contacts 122, 222 when the plugs 120, 220 are fully mated with the receptacles 110, 210 is arranged at a side of the receptacles 110, 210 closest to the first substrates 130, 230 and a side of the plugs 120, 220 closest to the first substrates 130, 230.

Preferably, the retention tabs 116 and 126 are electrically isolated from the receptacle contacts 112 and the plug contacts 122, such that the retention tab 116 of the receptacle 110 is not electrically connected with the plug 120, and the retention tab 126 of the plug 120 is not electrically connected with the receptacle 110.

Furthermore, while preferred embodiments of the present invention have been described above with respect to substrates, a mezzanine connector according to the preferred embodiments of the present invention may be used to connect any electrically conductive materials including, for example, printed circuit boards or other types of circuit substrates.

Additionally, while preferred embodiments of the present invention show the beams 121, 221 as preferably having substantially rectangular cuboid shapes, for example, the beams 121, 221 may have other shapes. The beams 121, 221 may have rounded edges, may have a triangular or trapezoidal cross-section, may be discontinuous along the length of the mezzanine connector, etc. Furthermore, the contacts 112, 122, 212, 222 may have shapes other than those shown in FIGS. 1-9, for example, cantilevered contacts, folded contacts, spring contacts, bellow contacts, etc., and the beams 121, 221 may be adjusted according to the shapes of the contacts 112, 122, 212, 222. Respective sizes and shapes of the beams 121, 221 and the contacts 112, 122, 212, 222 may be selected to provide an appropriate force normal to the mating direction of the receptacles 110, 210 and the plugs 120, 220.

The beams 121, 221 may also have lengths that are longer than the heights of the receptacles 110, 210, such that a portion each of the beams 121, 221 extends past the receptacles 110, 210 when the plugs 120, 220 are mated with the receptacles 110, 210. Accordingly, the beams 121, 221 may extend into or through the first substrates 130, 230, for example, to mate with another of the receptacles 110, 210 that is arranged on an opposite side of the first substrates 130, 230 or with another of the receptacles 110, 210 that is arranged on another substrate. As another example, the beams 121, 221 may be arranged to pass through the first substrates 130, 230 before connecting to the receptacles 110, 210.

According to preferred embodiments of the present invention, the receptacles 110, 210 and the plugs 120, 220 may include, as an insulating material, any thermoplastic material, thermoset material, ceramic material, glass, or similar dielectric material. Further, the contacts 112, 122, 212, 222 may include any copper alloy material.

Moreover, while preferred embodiments of the present invention show the substrates 130, 140, 230, 240 arranged in a parallel or substantially parallel manner, within manufacturing tolerances, the mezzanine connectors 100, 200 may be applied to other arrangements of substrates. For example, the plug 220 could be arranged at the edge of a substrate to provide an edge mount connection with the receptacle 210, in which the substrates are perpendicular or substantially perpendicular, within manufacturing tolerances.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A mezzanine connector comprising:

a first connector including a pass-through hole and a first plurality of contacts arranged around the pass-through hole, the first connector arranged to be connected to a first substrate such that the first plurality of contacts are connected to the first substrate; and a second connector including a beam and a second plurality of contacts arranged around the beam, the second connector arranged to be connected to a second substrate such that the second plurality of contacts are connected to the second substrate; wherein the pass-through hole extends fully through the first connector in a mating direction of the first connector and the second connector;

the beam of the second connector is arranged to extend into the pass-through hole of the first connector when the first connector and the second connector are mated such that each of the first plurality of contacts engages with a respective one of the second plurality of contacts; and the beam of the second connector touches the first substrate when the first connector is mated with the second connector.

2. The mezzanine connector of claim 1, wherein the first connector is arranged to fit to a cut-out of the first substrate.

3. The mezzanine connector of claim 2, wherein the first connector includes recessed portions and a main body that are arranged to fit into the cut-out of the first substrate.

4. The mezzanine connector of claim 1, wherein:

the first connector is soldered to the first substrate; and the second connector is soldered to the second substrate.

5. The mezzanine connector of claim 4, wherein:

a portion of each of the first plurality of conatcts and the second plurality of contacts, which are to be soldered to the first and second substrate respectively, include a ribbed or multi-planar area that limits the flow of solder.

6. The mezzanine connector of claim 1, wherein:

the first connector includes at least one first retention tab; and the second connector includes at least one second retention tab; wherein the at least one first retention tab is arranged to be connected to the first substrate; and the at least one second retention tab is arranged to be connected to the second substrate.

7. The mezzanine connector of claim 6, wherein:

a height of each of the first plurality of first contacts is equal to or greater than a height of the at least one first retention tab; and a height of each of the plurality of second contacts is equal to or greater than a height of the at least one second retention tab.

8. The mezzanine connector of claim 1, wherein at least one of the first connector and the second connector includes at least one post to engage with at least one corresponding post hole in the first or second substrate.

9. The mezzanine connector of claim 1, wherein a wipe distance of the first plurality of contacts and the second plurality of contacts is about 0.6 mm or greater.

10. The mezzanine connector of claim 1, wherein a distance between the first substrate and the second substrate is about 2 mm or less when the first connector and the second connector are mated together.

11. The mezzanine connector of claim 1, wherein a wipe distance of the first plurality of contacts and the second plurality of contacts is greater than a distance between the first substrate and the second substrate.

12. The mezzanine connector of claim 1, wherein:

an initial point of contact between the first plurality of contacts and the second plurality of contacts during mating of the first connector to the second connector is arranged at a side of the first connector closest to the second substrate and a side of the second connector closest to the first substrate; and a resting point of contact between the first plurality of contacts and the second plurality of contacts when the first connector is fully mated with the second connector is arranged at a side of the first connector closest to the first substrates and a side of the second connector closest to the first substrate.

13. The mezzanine connector of claim 1, wherein:

the first plurality of contacts is arranged in at least one row; and the second plurality of contacts is arranged in at least one row.

14. The mezzanine connector of claim 1, wherein a bottom surface of the beam of the second connector is parallel or substantially parallel to a bottom surface of the first connector.

15. A connector assembly comprising:

a first connector including a pass-through hole and a first plurality of contacts arranged along the pass-through hole;

a second connector including a beam and a second plurality of contacts arranged along the beam;

a first substrate; and a second substrate; wherein the first connector is arranged to be connected to the first substrate such that the first plurality of contacts is connected to the first substrate;

the first connector includes a pass-through hole extending fully through the first connector in a mating direction of the first connector and the second connector;

the second connector is arranged to be connected to the second substrate such that the second plurality of contacts is connected to the second substrate;

the beam of the second connector is arranged to engage the pass-through hole of the first connector when the first connector and the second connector are connected such that each of the first plurality of contacts engages with a respective one of the second plurality of contacts; and the beam of the second connector touches the first substrate when the first connector is mated with the second connector.

16. The electrical connector assembly of claim 15, wherein:

the first substrate and the second substrate each include a cut-out or a recess;

the first connector is arranged to fit to the cut-out or the recess of the first substrate; and the second connector is arranged to fit to the cut-out or the recess of the second substrate.

17. A receptacle connector comprising:

a plurality of contacts; and a pass-through hole; wherein the plurality of contacts is arranged in at least one row along the pass-through hole; and the pass-through hole extends fully through the receptacle connector such that when the receptacle connector mates with another connector, a bottom surface of the another connector is co-planar or substantially co-planar to a bottom surface of the receptacle connector; and a portion of each of the plurality of contacts includes a ribbed or multi-planar area that limits the flow of solder.

18. The receptacle connector of claim 17, wherein the pass-through hole extends along the receptacle connector between a first retention tab and a second retention tab of the receptacle connector.

19. The receptacle connector of claim 17, wherein the receptacle connector is arranged to fit to a cut-out of a substrate.

20. The receptacle connector of claim 19, wherein the receptacle connector includes recessed portions and a main body that are arranged to fit into the cut-out of the substrate.

* * * * *